US006200216B1

(12) United States Patent
Peppel

(10) Patent No.: US 6,200,216 B1
(45) Date of Patent: Mar. 13, 2001

(54) ELECTRONIC TRADING CARD

(75) Inventor: Tyler Peppel, 109 W. St., No. 1, Sausalito, CA (US) 94965

(73) Assignee: Tyler Peppel, Mill Valley, CA (US)

( * ) Notice: Subject to any disclaimer, the term of this patent is extended or adjusted under 35 U.S.C. 154(b) by 0 days.

(21) Appl. No.: 08/398,862

(22) Filed: Mar. 6, 1995

(51) Int. Cl.[7] ..... A63F 9/24
(52) U.S. Cl. ..... 463/1; 463/43; 380/4
(58) Field of Search ..... 364/479.01, 408; 273/461, 460, 244.2, 244; 463/1, 36, 4, 3, 37, 40, 16; 380/4

(56) References Cited

U.S. PATENT DOCUMENTS 4,977,503 * 12/1990 Rudnick et al. .
5,026,058 * 6/1991 Bromley .
5,411,259 * 5/1995 Pearsen et al. .
5,533,124 * 7/1996 Smith et al. .

* cited by examiner

*Primary Examiner*—Michael O'Neill
(74) *Attorney, Agent, or Firm*—Michael A. Glenn

(57) ABSTRACT

A system for the application of a trading card metaphor to a disassociated computer program and the unique design of several hardware and software systems supports and enhances collecting, trading, game playing, and creating of digital electronic trading cards by taking the traditional trading card metaphor and uniquely updating and enhancing it for application in consumer digital media. An electronic hardware and software architecture for electronic trading cards (ETCs) has a number of components that function together as a system that support making electronic trading cards, trading electronic trading cards, activities (such as game playing) with electronic trading cards, and collecting electronic trading cards. The ETC format is embodied in the components of the electronic trading card system, which are designed to generate and accept a common proprietary electronic trading card format, so that, for example, a card created in a card-making application can be recognized by an electronic trading card album. The card format supports both scarcity and authenticity, which are essential to card collecting and trading, within a disassociated computer code segment.

39 Claims, 12 Drawing Sheets

ELECTRONIC TRADING CARD

BACKGROUND OF THE INVENTION

1. Technical Field

The invention relates to the storage and dissemination of information in an electronic format. More particularly, the invention relates to the dissemination of such information based on scarcity and authenticity.

2. Description of the Prior Art

Paper trading cards have been popular for over 100 years. Over the course of several generations, children and adults have enthusiastically collected and traded sports cards. Over the last 15 to 20 years the content of trading cards has expanded to include cartoon characters (e.g. The Lion King), fantasy figures (e.g. Star Trek, Dungeons and Dragons), role playing games, wildlife, and even famous criminals.

Very few children's activities have had the generation-after-generation acceptance and popularity of trading cards. Throughout their history, the patterns of use and technology of trading cards have remained constant. Cards have been printed in color on cardboard, serially numbered and sold in retail stores, and more recently in specialty trading card stores. Trading card collecting magazines are published worldwide and trading card conventions are held in all major US cities. Paper cards are even traded over the Internet.

The fundamental appeal of trading and collecting scarce but inexpensive trading cards is an international phenomenon. Trading cards are very popular in Japan and in Europe, and although they contain content of local interest, the ways they are sold, collected, and traded are very similar to the United States.

Children buy cards and attempt to collect a complete series of a particular type of card. They trade with their friends to fill gaps in a card series and augment their collections. Within the last 5–10 years, trading card games have emerged (such as Magic-The Gathering) that combine the game play of traditional card games with the activity of trading card collecting. In existing trading card games, the completeness of your card collection gives you advantages in the game against other players.

In parallel with this strong continuing consumer interest in trading cards, several trends have recently become apparent in consumer multimedia technology:

Consumer purchases of multimedia equipped personal computers and advanced video game systems have been escalating rapidly. The multimedia computer is poised to take its place as the heir to the video game and VCR as a major focal point of family leisure. At the same time, video game systems are growing in capabilities and becoming almost computer-like in their functionality as they add stereo sound capabilities, CD-ROM drives, and writable data storage.

The number of subscribers to consumer on-line services is growing rapidly. Consumers are becoming educated and familiar with the concept of "cyberspace" where distance is not a factor in sharing E-mail and other digital data with fellow subscribers.

Data compression technology is becoming affordable and accessible to consumers. Data compression techniques are becoming common features of consumer media and computer products.

The capacity of digital storage media is increasing as prices fall. Floppy discs, optical storage, and hard drives are all holding more data at lower and lower cost.

A generation of electronically-literate children is coming of age. Today's children in the trading card age range (Le. 8–14 years of age) are familiar and comfortable with electronic environments. They've grown up in a world of sophisticated electronic special effects in movies, complex video games which challenge their game playing skills and more recently, multimedia computers with modems and CD-ROM drives.

Although these trends may seem loosely related, they converge in a potential product opportunity to create systems for disassociated consumer multimedia, i.e. multimedia products that allow consumers to browse, create, collect, and exchange disassociated pieces of multimedia data. Almost all multimedia software is published today as large, monolithic collections of data that can only be browsed by the consumer—much like the analog publishing model of books and movies.

The trends mentioned above create the potential for electronically literate consumers to take advantage of data compression and affordable high-density storage to create, collect, and exchange disassociated pieces of multimedia information using their multimedia personal computers and video game systems. Collecting and exchanging can occur on physical media such as high fdensity floppy discs or on on-line systems. Early manifestations of this opportunity are seen today in electronic mail and children's electronic paint programs which allow graphics to be created on screen by consumers.

Various alternative format greeting cards and related systems are known in the art. See, for example U.S. Pat. No. 5,120,589, Collectible Promotional Card, which is a method of printing a photographic image on the laminate; U.S. Pat. No. 5,282,651, Trading Cards and Method of Concealing and Revealing Information, which discloses trading cards that are interactive with the user by concealing under a secondary show under a coating, i.e. it is a form of a scratch card; and U.S. Pat. No. 5,036,472, Computer Controlled Machine For Vending Personalized Products Or The Like, provides an electronic vending machine that allows one to compose a greeting card, and then print it on the spot, i.e. it is a machine for vending greeting cards or personalized customized products at the point of sale. Thus, the '472 patent provides a series of electronic forms from which one can select a desired greeting card format and enter personalization information into the form.

Other art that provides a background for the invention includes: U.S. Pat. No. 4,890,229, Electronic Baseball Card, discloses a calculator that stores sports information; U.S. Pat. No. 5,056,029, Method and Apparatus for Manufacturing and Vending Social Expression Cards, discloses a system for point-of-sale card manufacturing and vending; U.S. Pat. No. 5,356,151, Scale Model Game, discloses a game board. U.S. Pat. No. 5,338,043, Cryptographic Guessing Game, discloses a puzzle game which one of several players can play, and that includes cyphertext and indicia, where the cyphertext is an encrypted message that may include hidden information; U.S. Pat. No. 5,091,849, Computer Image Production and System Utilizing First and Second Networks for Separately Transferring Control Information and Digital Image Data, discloses a computer imaging system used to produce animation.

Additionally of interest are related U.S. Pat. No. 4,951,203, Computer Card, and U.S. Pat. No. 4,965,727 Computer Card. The '203 patent discloses a greeting card created, and readable, by a digital computer, and that requires a magnetic medium means, such as a magnetic card or magnetic disk, for storing a plurality of messages and a plurality of audio selections. The message can be a visual message that is displayed in connection with the reproduction of audio information. The message must include a control file that is used to configure the source computer. Thus, the '203 patent discloses a multimedia format in which audio and video are linked with a run time module and stored on a magnetic medium for use in a computer system.

The '727 patent discloses a system for processing and supervising a plurality of composite intercourse and social communication selections of a product. The "supervising" element of the '727 disclosure is directed to perception by the recipient of the continuous generation of a design, message, and audio output under the supervision of the computer operating system to provide a plurality of multimedia outputs in synchronization, rather than one at a time. The greeting card generated is used to communicate a personal message to another being in a social atmosphere that consists of a preprinted picture and a preprinted message, with an audio portion such as a musical selection added.

The entire interpersonal social communication is stored on a fixed medium in one location. A computer greeting card thus generated can be used at that location as is and modified to improvise a user-created message of a special emotional meaning between the user and the recipient of the greeting card. If the recipient is at a remote location, the user may mail the fixed medium to the recipient. The recipient then inserts the interpersonal social communication into a computer, and the computer produces a synchronized audio/visual presentation.

SUMMARY OF THE INVENTION

The invention provides a system for the application of a trading card metaphor to a disassociated computer program and the unique design of several hardware and software systems which support and enhance collecting, trading, game playing, and creating of digital electronic trading cards. Thus, the invention takes the traditional trading card metaphor and uniquely updates and enhances it for application in consumer digital media.

The invention includes an electronic hardware and software architecture for electronic trading cards (ETCs). The invention has a number of components that function together as a system that support making electronic trading cards, trading electronic trading cards, activities (such as game playing) with electronic trading cards, and collecting electronic trading cards.

The Electronic Trading Card format is embodied in all components of the electronic trading card system. These components are designed to generate and accept a shared proprietary electronic trading card format, so that, for example, a card created in a card-making application can be recognized by an electronic trading card album. The card format is also important because it supports the concepts of scarcity and authenticity (essential to card collecting and trading) within a disassociated computer code segment.

ETCs have a proprietary data format made up of a number of components, including:

a) ETC Header Identification, i.e. an ASCII string which uniquely identifies the ETC and a lock and key mechanism to limit access and impose password protection if desired;

b) ETC Graphic Identification, such as audio visual logo, copyright notice, company information;

c) Multimedia Data, such as animation, video, pictures, sounds, text;

d) Pointers to external data and programs embedded in scripts which trigger the display of external media or run external applications;

e) Utility Programs, such as copy protection, printing, telecommunications protocols, self destruction (erasing) routines;

f) Applications, including incomplete linkable code segments, games, puzzles, and utilities; and g) User Writable Area for personalization, ASCII messages, voice recording, score keeping.

DETAILED DESCRIPTION OF THE INVENTION

The invention provides a system for the application of a trading card metaphor to a disassociated computer program and the unique design of several hardware and software systems which support and enhance collecting, trading, game playing, and creating of digital electronic trading cards. Thus, the invention takes the traditional trading card metaphor and uniquely updates and enhances it for application in consumer digital media.

The invention provides an electronic hardware and software architecture for electronic trading cards (ETCs). The invention has a number of components that function together as a system that support:

making electronic trading cards;

trading electronic trading cards;

activities (such as game playing) with electronic trading cards; and collecting electronic trading cards.

Runtime Engine. Another important component of the ETC architecture is a separate runtime engine that must be present in the local computing device for a user to view and interact with an ETC. The runtime engine is a compact assembly code program that is made up of functions used by most ETCs: media handlers and display routines, a timing mechanism, display management, and input handlers.

Figure 1:
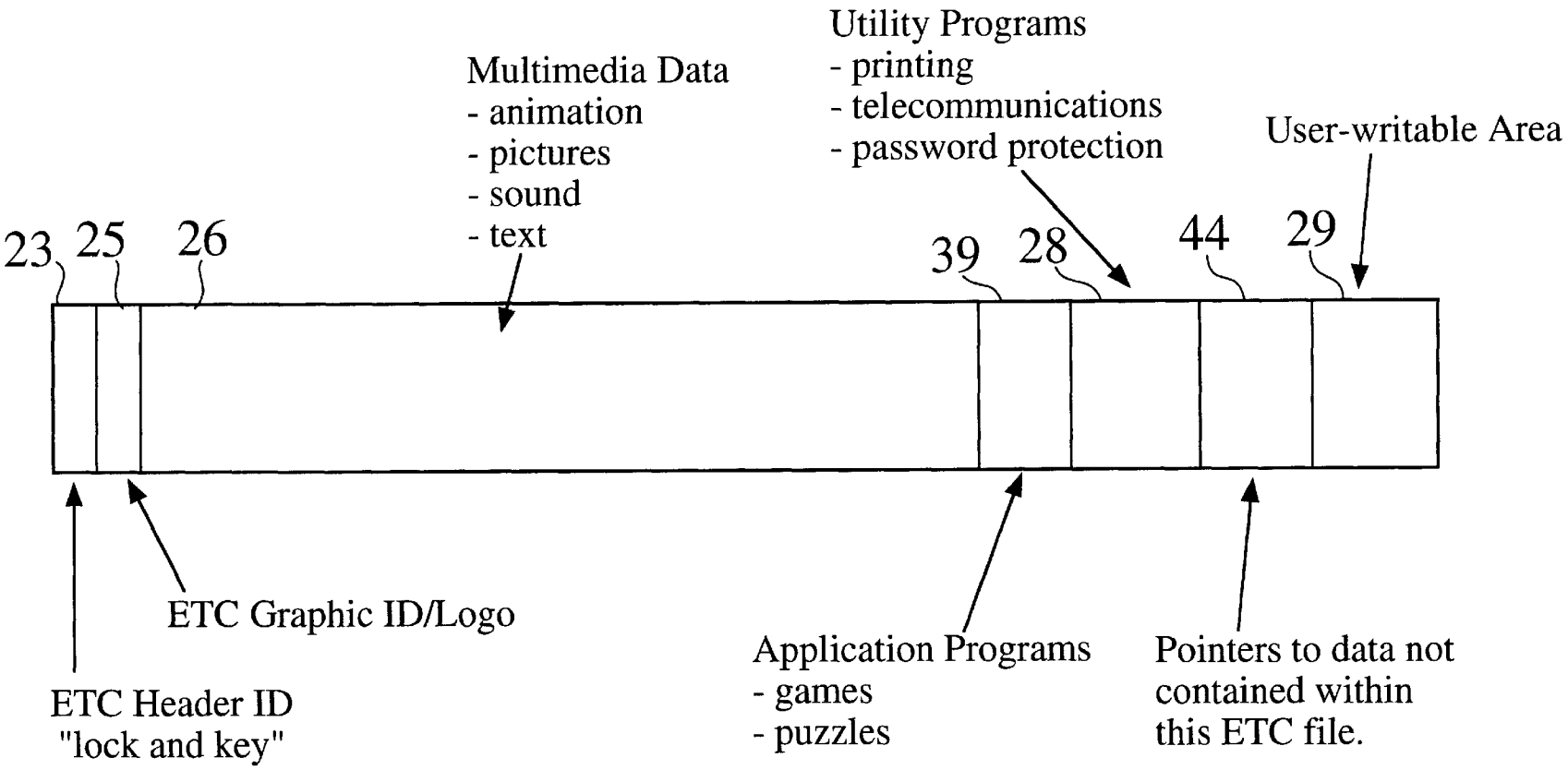
FIG. 1 is a diagram of an electronic trading card data format according to the invention.

The Electronic Trading Card Format. FIG. 1 is a diagram of an electronic trading card data format according to the invention. The card format is a global concept embodied in all components of the electronic trading card system. These components are designed to generate and accept a common proprietary electronic trading card format, so that, for example, a card created in a card-making application can be recognized by an electronic trading card album.

The card format is also important because it supports the concepts of scarcity and authenticity (essential to card collecting and trading) within a disassociated computer code segment.

The ETC Data Format. ETCs have a proprietary data format 26 made up of a number of components:

- ETC Header Identification 23, i.e. an ASCII string which uniquely identifies the ETC and a lock and key mechanism to limit access and impose password protection if desired.
- ETC Graphic Identification 25, such as audio visual logo, copyright notice, company information.
- Multimedia Data 27, such as animation, video, pictures, sounds, text.
- Pointers to external data and programs embedded in scripts which trigger the display of external media or run external applications 44.
- Utility Programs 28, such as copy protection, printing, telecommunications protocols, self destruction (erasing) routines.
- Applications, including incomplete linkable code segments, games, puzzles, and utilities 39.
- User Writable Area 29 for personalization, ASCII messages, voice recording, score keeping.

Media Independence. In all cases, the ETC software is optimized to be as media-independent as possible, meaning it depends as little as possible on any media-specific data formats. ETCs are intended to be transportable across a wide range of digital media, including CD-ROM, networked servers, fixed discs, floppy discs, data cards, writable optical storage, and RAM.

Platform Independence. In all cases, the ETC software is optimized to be as platform-independent as possible, meaning it depends as little as possible on any machine specific routines or functions. ETCs are intended to be transportable across a wide range of digital computing platforms including personal computers, video game machines, set-top boxes, personal digital communicators, and handheld computing devices. For purposes of the discussion herein, a set top box is defined as a networked or non-networked computing device which uses a consumer television set as a display monitor.

Figure 2:
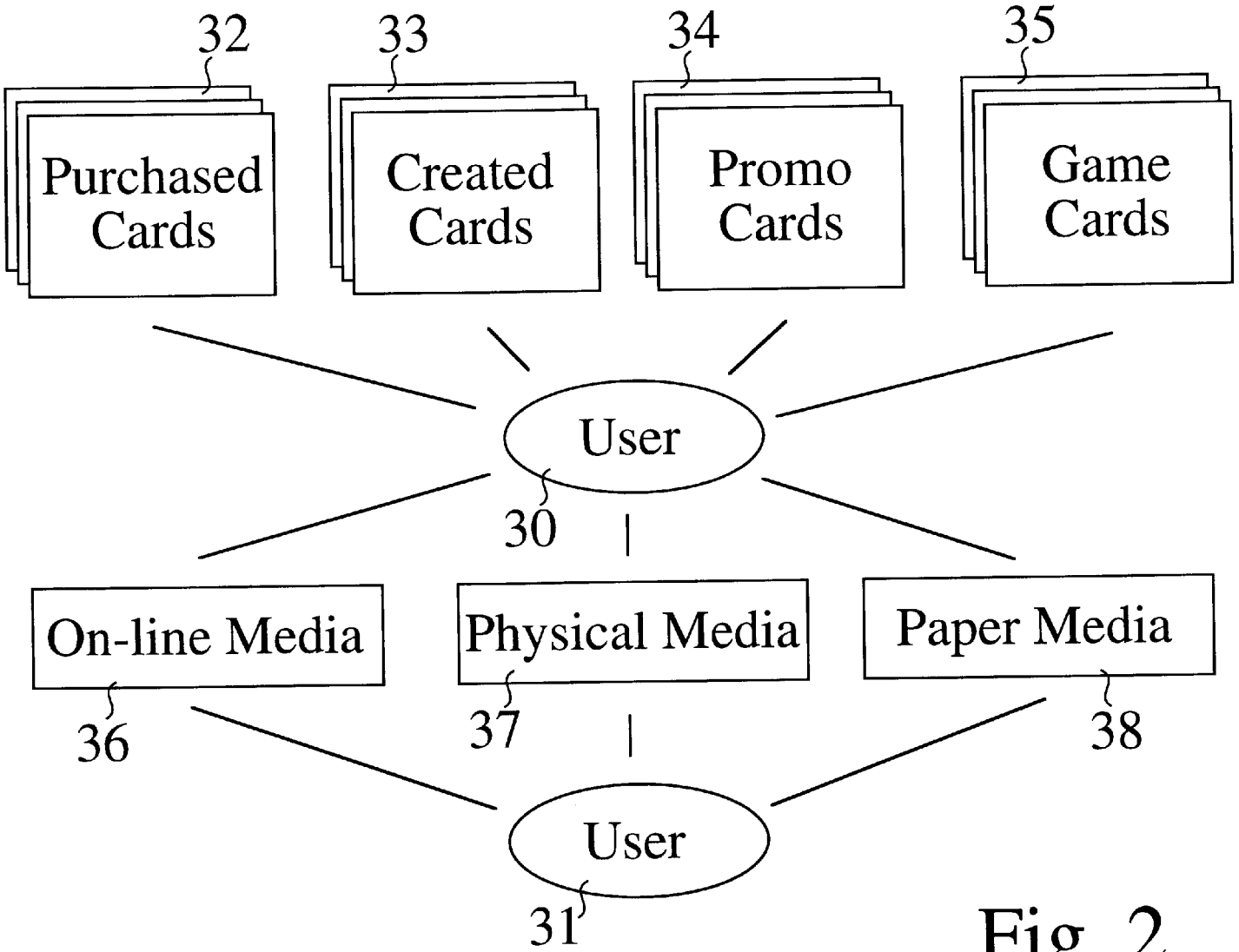
FIG. 2 is a block diagram of a user trading card trading environment according to the invention.

FIG. 2 is a block diagram of a user trading card trading environment according to the invention. In the figure, a user 30, 31 has access to trading cards in various formats, including purchased cards 32, created cards 33, promotional cards 34, and game cards 35. The cards are stored and accessed in various media, including on-line media 36, physical media 37, and paper media 38.

Figure 3:
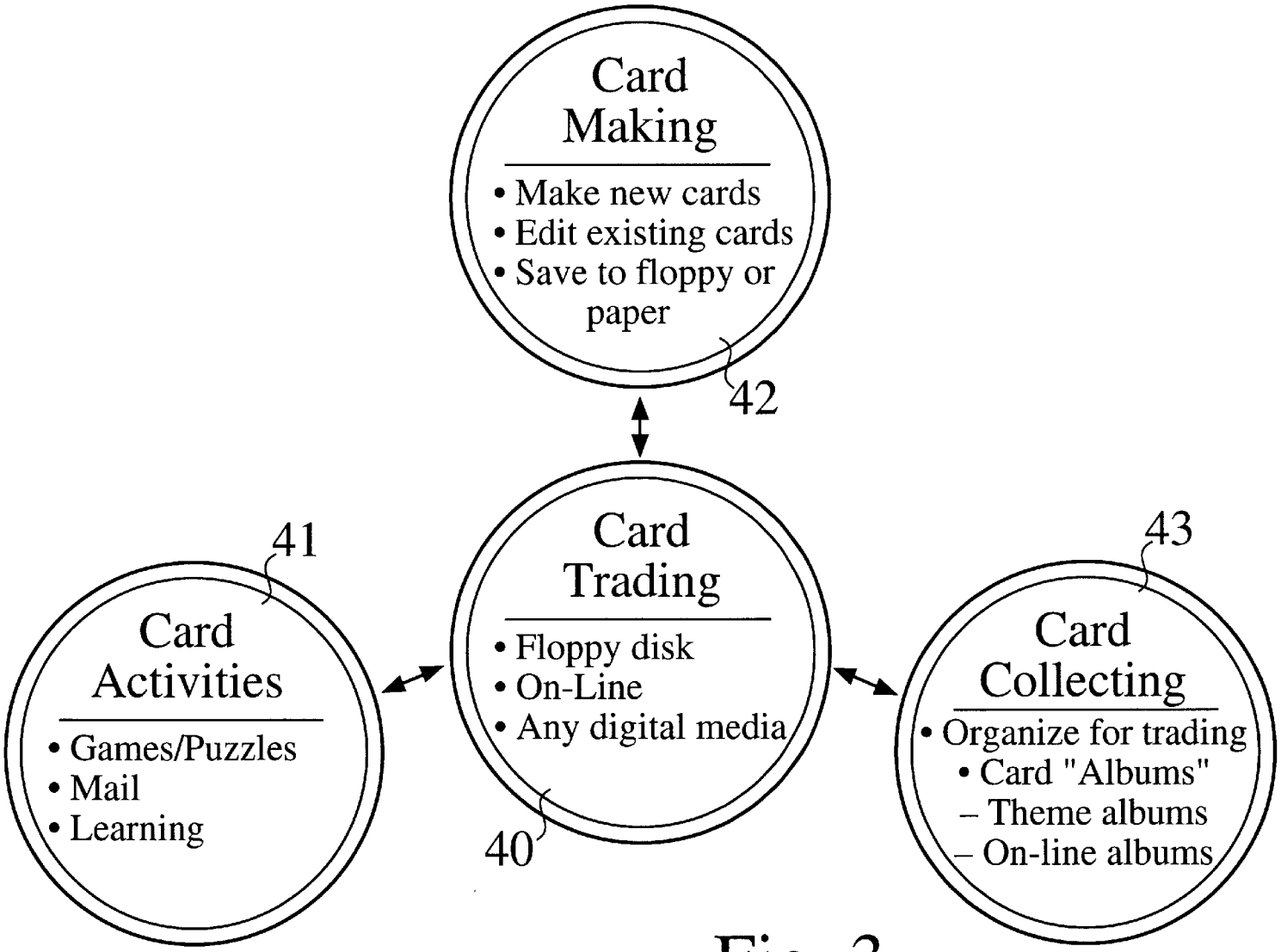
FIG. 3 is a block diagram of a trading card activity model according to the invention.

FIG. 3 is a block diagram of a trading card activity model according to the invention. In the figure, the card trading activity 40 takes place via a floppy disk, on-line service, or any other digital medium. Card trading includes various card activities 41, such as games and puzzles, sending and receiving mail, and learning; card making 42, such as making new cards, editing existing cards, and saving cards to various media, such as a floppy disk or paper; and card collecting, such as organizing cards for trading and build card albums, such as theme albums and on-line albums.

Figure 4:
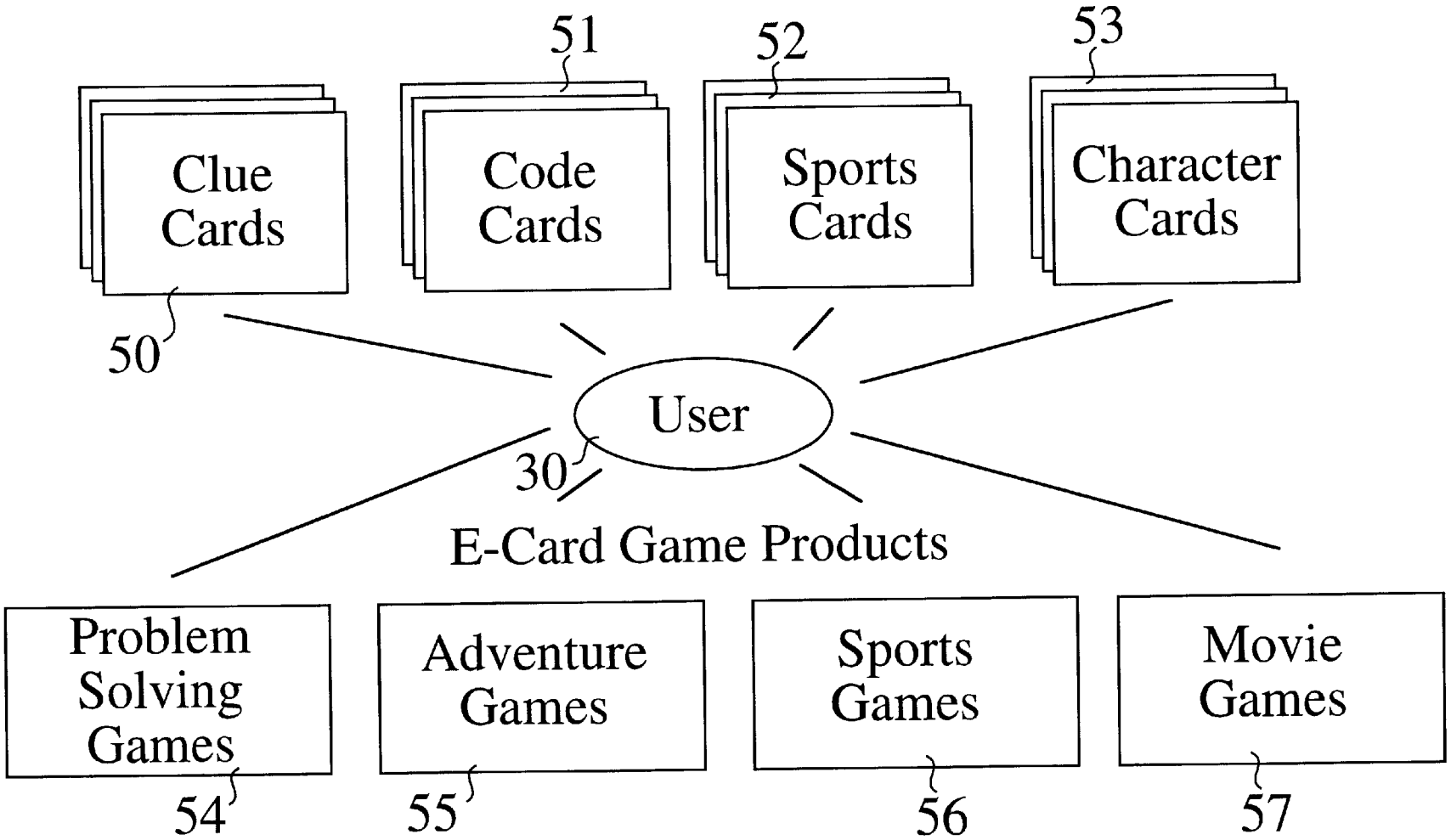
FIG. 4 is a block diagram of a user trading card game products model according to the invention.

FIG. 4 is a block diagram of a user trading card game products model according to the invention. In the figure, a user 30 has access to several electronic card products, including clue cards 50, code cards 51, sports cards 52, and character cards 53. The cards are used in various activities, such as problem solving games 54, adventure games 55, sports games 56, and movie linking games 57. These products operate in the context of a card trading environment and may be combined, for example an adventure game involving character cards that include clues for playing the game.

Figure 5:
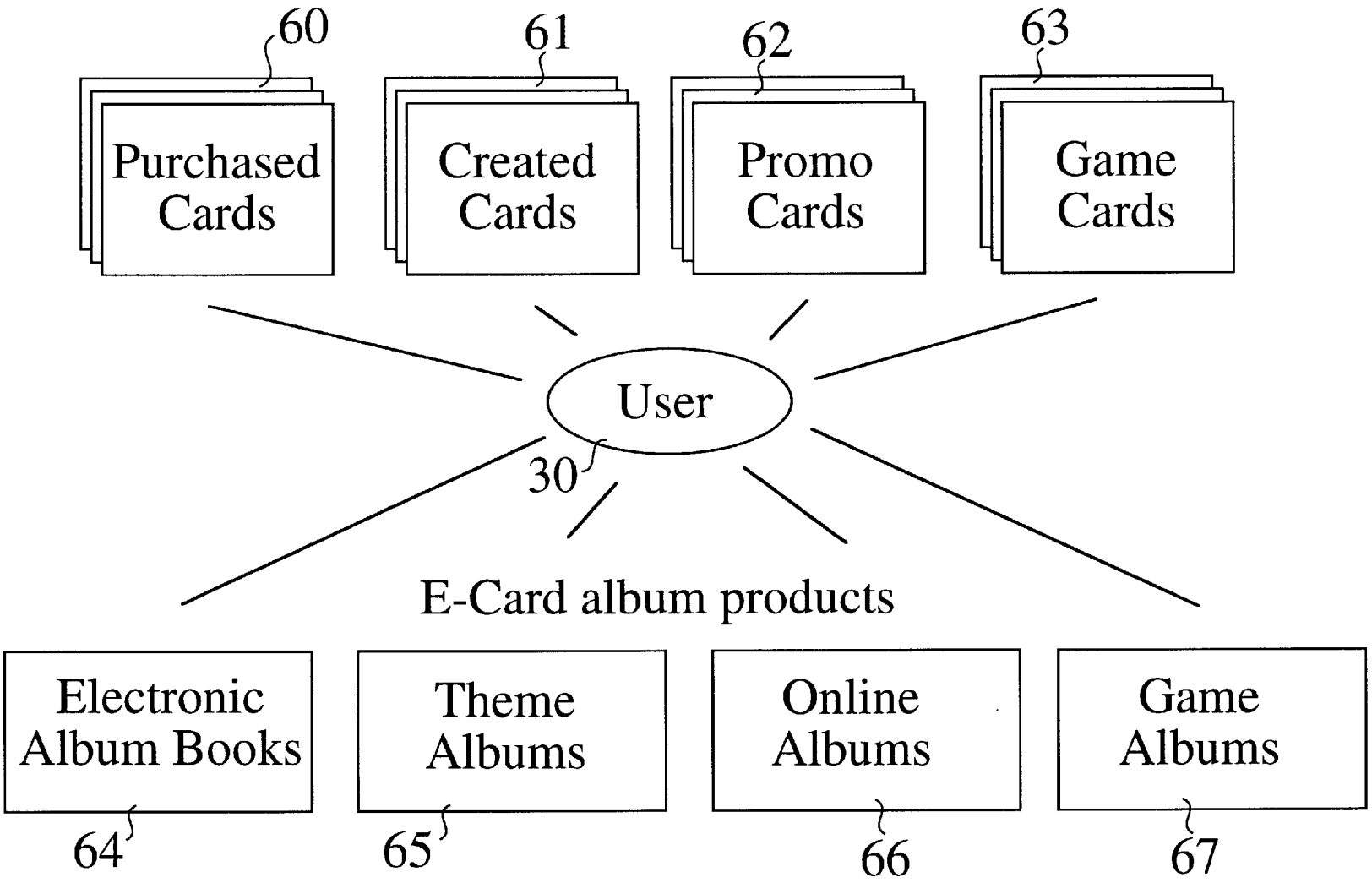
FIG. 5 is a block diagram of a user trading card album products model according to the invention.

FIG. 5 is a block diagram of a user trading card album products model according to the invention. In the figure, a user 30, has access to various card products, including purchased cards 60, created cards 61, promotional cards 62, and game cards 63. The cards are collected and provide the basis for assembling a card album. Card albums may be created in the form of electronic album books 64, theme albums 65, on-line albums 66, and game albums 67.

ETC Scarcity. Scarcity is an essential component of the traditional trading card metaphor and it is preserved and significantly enhanced in the ETC invention.

ETCs offer a number of new ways to generate card scarcity:

- User Skills. Users can solve a puzzle within the ETC and in so doing so, effect a change in the ETC which makes it rarer. For an example of this see the ETC Series Games below
- Timing. Timing can be used to generate scarcity in ETCs in a number of ways:
  - ETCs can self-destruct (self erase) after a given time has elapsed;
  - cards can be made available for limited times on on-line systems;
  - ETCs can be time stamped. Of an already rare type of ETC, the rarest might be the one with the earliest time stamp.
- Copy Protection. Copy protection limits the number of times an ETC can be copied. Counterfeit ETCs can be detected by using public-key/private-key encryption.
- Limited Manufacturing. When combined with copy protection, limited manufacturing of ETCs is a simple way of generating scarcity.
- Random Distribution of Partial Sets. In keeping with the existing paper trading card metaphor, random partial sets of a series of cards can be distributed. For example, of a series of 10 ETCs, one starter kit for the series might contain ETCs 3, 8, 2, and 9. Another kit might contain 1, 4, 5, and 10. Another kit might contain 6, 7, 3, and 9. All these kits look identical to the user, who has no way of knowing which cards were contained in the starter kit being purchased.

Figure 6:
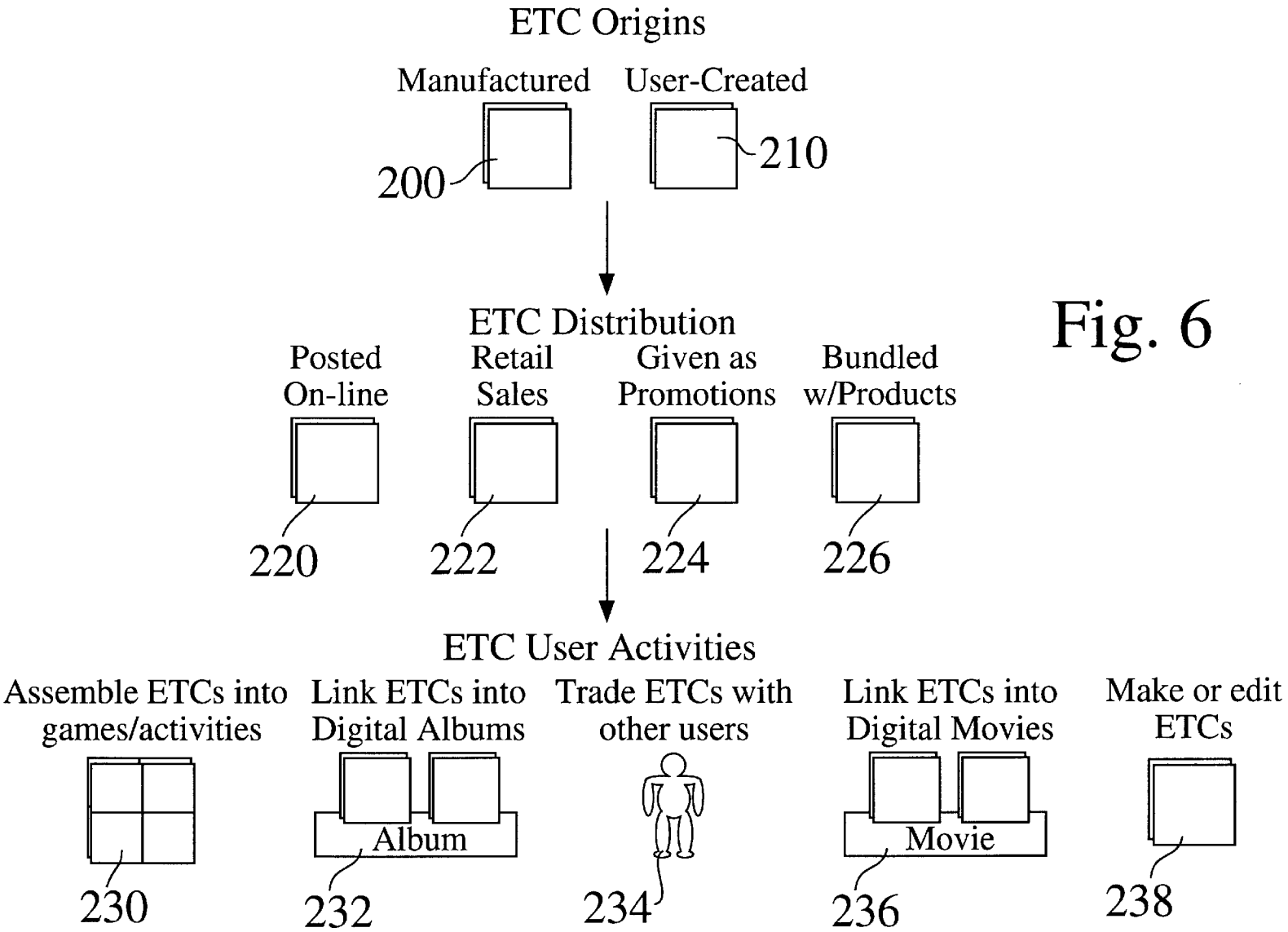
FIG. 6 is a flow diagram of an electronic trading card architecture according to the invention.

FIG. 6 is a flow diagram of an electronic trading card architecture according to the invention. In the figure, an ETC is originated by manufacture (200) or by user creation (210). The ETC is distributed through such channels are on-line posting (220), retail sales (222), promotional collateral (224), and bundled with other products (226). The ETC is then used for various activities (as discussed briefly above and in greater detail below), including assembly into games and activities (230), linkage into digital albums (232), trading with others (234), linkage into digital movies (236), and making or editing of ETCs (238).

Electronic Trading Cards On-Line. On-line capability is a very important aspect of the ETC invention. When combined with unique software programs that are part of this invention, on-line systems support browsing, trading, buying and selling, auctioning, group and individual collecting, and group and individual creation of ETCs.

Figure 7:
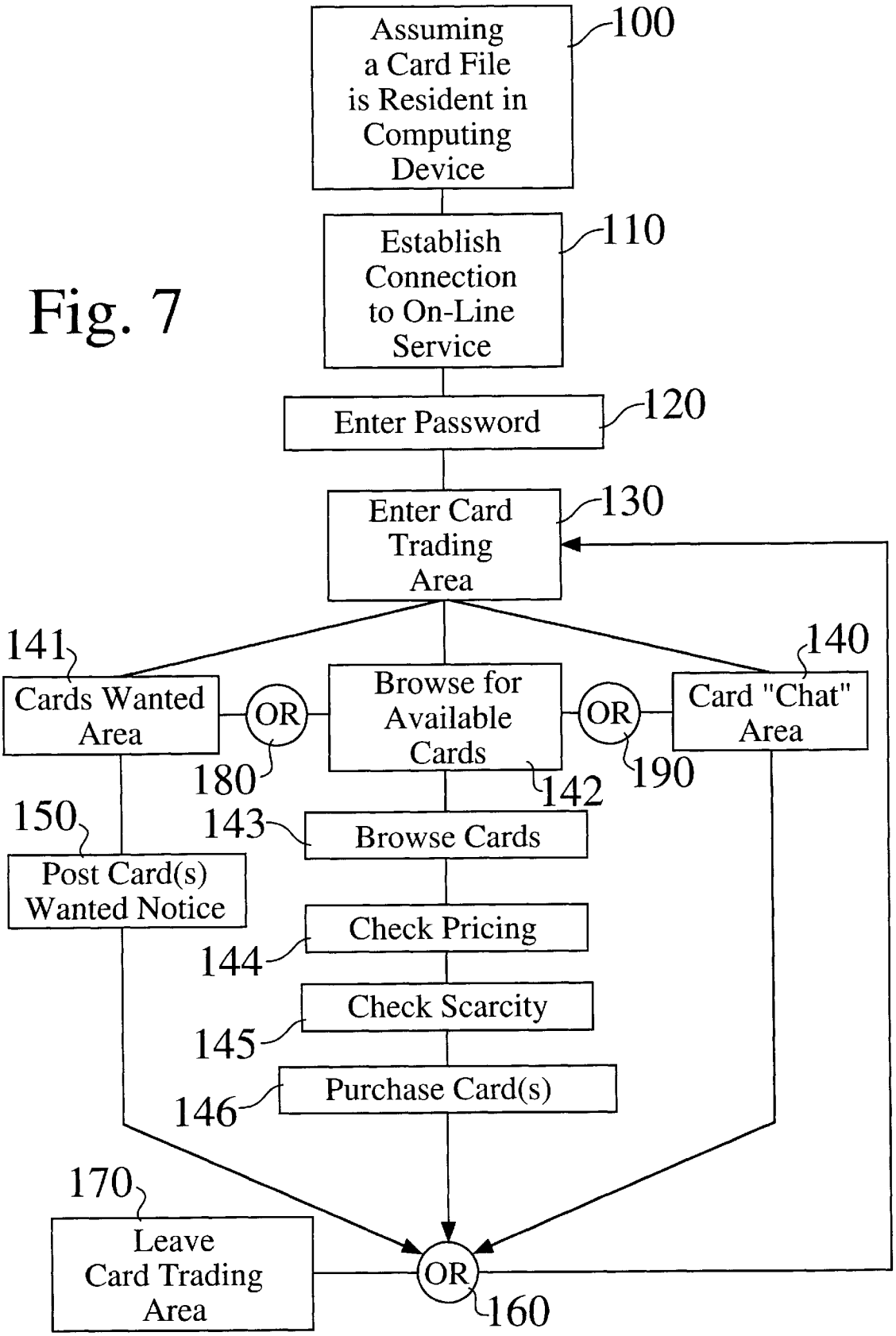
FIG. 7 is a flow diagram of an electronic trading card trading model according to the invention.

FIG. 7 is a flow diagram of an electronic trading card trading model according to the invention. To use ETC capabilities on-line, a resident card file is accessed (100) when the user connect his computer to a remote computer or server (110) that contains ETC files and utilities. After providing a valid password (120), the user enters the card trading area (130). Utilities are simple stand alone programs that allow users to browse, organize, and display cards. The user may dial in from any device that offers the functionality of a computer terminal, e.g. a personal computer, a set-top box which effectively turns a television into a computer terminal, or an advanced video game system which does the same. Once connected to the remote computer by established protocols, the user can access ETC files and utilities which support the browsing (142), trading, buying and selling (141), auctioning, group and individual collecting, group and individual creation of ETCs, and on-line card-related discussions (140). The user is able to move from one area to another by selecting a hyper text link or menu branching (180), (190), (160). In the card trading area (141), a user may post a card wanted notice (15) or perform similar such transactions. In the browser (142), a user may browse various cards (143), check card pricing (144), check card scarcity (145), and purchase cards (146). When the user has completed his visit to the on-line trading area, he may log off (170).

ETC collecting on-line significantly extends the traditional metaphor for paper trading card collecting. With access to a computing device and network connection, users are able to browse remote databases in search of particular ETCs and execute purchases and trades of ETCs with individuals and companies worldwide.

Important aspects of the ETC on-line experience are:

- a worldwide network of ETC trading sites accessible to companies and individuals;
- the concept of scarcity and authenticity in regard to an electronic ETC file; and
- the ability for geographically separate individuals to form ad hoc alliances for trading and collecting.

Browsing an ETC trading center. Listings of ETCs which are either resident on the server or have been listed there as available by other users or card manufacturers can be browsed and mail can be exchanged between potential buyers and sellers of cards. On-line card trading centers might be of any scale, from two users trading back and forth, to thousands of trades in progress simultaneously, creating an exciting, highly charged atmosphere.

Group and Individual Collecting of ETCs on-line. ETCs are offered for free, for promotional purposes, for sale or for trade on computer servers worldwide. Collectors with access to those servers through commercial services, such as CompuServe or America On-line, and non-commercial services, as the Internet, can search to find ETC files they are interested in collecting and then trade for or purchase those ETC files (see below). Ad hoc teams can be formed to collect ETCs competitively against other teams.

On-line collecting activity can take several forms:

- connecting to a single sever location and downloading ETCs;
- successfully following a trail of clues regarding the location of a series of ETCs. For example, a user purchases the first card in a series, ETC "A" in an ETC trading card shop. On ETC "A" there is a clue which leads the user to the on-line location of ETC "B". ETC "B" contains a clue as to the location of ETC "C" and so on; and
- competing with other groups and individuals to find missing ETCs in a series and complete a collection on-line. This is somewhat like a virtual scavenger hunt. The first group or individual to complete the series by posting all cards in the series in a location on-line wins.

The relationship between on-line ETCs and ETCs available on physical media. Relationships between on-line ETCs and ETC products available on physical media are assumed in the ETC invention. These relationships are manifested in several ways:

- file format compatibility;
- lock and key security systems so that only a specific ETC found on line can be placed in a specific local in a collector's album program, for example;
- a consistent look and feel in terms of visual and audio design.

A complete series of ETCs might be offered as individual cards across several media, with some of the cards only available in a commercial product series starter kit on CD-ROM, some of the cards offered as promotional give-aways or bundled with related product purchases, such as toys or movie tickets, and some of the cards available only on-line. To complete the series the user must find the series ETCs in a number of disparate locations and bring them together within an ETC collector's album program created for the series.

ETC scarcity on-line. ETC scarcity on-line can be generated by offering ETCs for a limited time, or at a limited number of places, or both. For example an announcement such as this might be posted on-line: "A rare "Blue Wizard Diamond" ETC will be offered at (phone number) for 5 minutes at midnight July 22nd, Tokyo time. Only the first 1000 collectors to log on will be able to download the card." These example numbers, dates, and times are arbitrary. Additional scarcity could be generated by adding further conditions, such as making a password necessary, even if the user has logged on at the specified time and place.

Buying and Selling of ETCs on-line. Buying and selling is very similar to Trading (below) except that instead of exchanging ETCs for other ETCs, currency is exchanged for ETCs:

- users can negotiate via electronic mail or other means;
- users can post offers to buy and sell at specific locations. Offers are then stored and forwarded to owners of cards when they log onto the system (silent bidding); and
- cards can be offered for sale at live, real time auctions with bids submitted by simultaneously connected users.

Trading of ETCs on-line. Trading can be accomplished through communication between users of an on-line system in a number of ways:

- users can negotiate via electronic mail or other means;
- users can post offers for trades at specific locations. Offers are then stored and forwarded to owners of cards when they log onto the system (silent bidding); and
- cards can be offered for trade at live, real time auctions with bids submitted by simultaneously connected users.

Physical ETC Trading. In addition to the on line trading mentioned above, ETCs may traded in more traditional, low-tech ways. Single or multiple ETCs may be copied onto writable media and the media exchanged physically. To enhance this activity, adhesive labels for portable writable media, such as floppy discs, are included with ETC products. Completed ETC/paper card hybrids (described below) may also be traded physically.

ETC/Paper Trading Card Hybrids. The ETC invention has a functional relationship to paper trading cards. In fact, a special type of incomplete paper trading card is a component of the ETC invention.

Paper incomplete-cards are sold bundled with ETC products and also sold separately. The incomplete-cards are designed in formats that allow them to be used in common computer printers. These incomplete-cards are unique in that they are paper trading cards but some aspect of their printed information is missing. The missing information is provided through the use of a computer-based ETC product. When the information is found, it can be printed onto designated areas of the card in a printer attached to the computing device in which the ETC program is resident. In this way, disassociated information from the ETC computer program completes the incomplete paper card, creating a hybrid ETC/traditional paper trading card.

This ability to create hybrid ETC/paper trading cards has several applications within the ETC invention:

Personalization of the incomplete cards with names, messages, secret codes, and pictures;

Updating information, such as current sports statistics which were not available when the incomplete card was originally printed;

Revealing clues for a game. An incomplete card might show an image of a map, but trails on the map are missing. During an ETC Adventure Game (described elsewhere herein) a player may earn the right to print on the incomplete map card. When the ETC incomplete-card of the map is passed through the printer, the ETC program resident in the computing device prints a trail on the map, showing the safest way over the terrain; and As a means of generating scarcity. In some cases, hidden information must be found or puzzles solved within an ETC program before the incomplete card can be completed. The more difficult the problem to be solved, the more scarce the completed card. Incomplete cards could also be completed in stages through multiple passes through the printer, as stages or levels of an ETC game are solved.

Trends cited above note the growing popularity of multimedia personal computers and video game systems among consumers. When combined with a unique software program that is a part of this invention, these systems can become platforms for the end-user creation of electronic trading cards. Electronic card creation, as taught by the invention, significantly extends the metaphor of traditional paper trading cards, where card creation is not feasible for the individual end-user.

Figure 8:
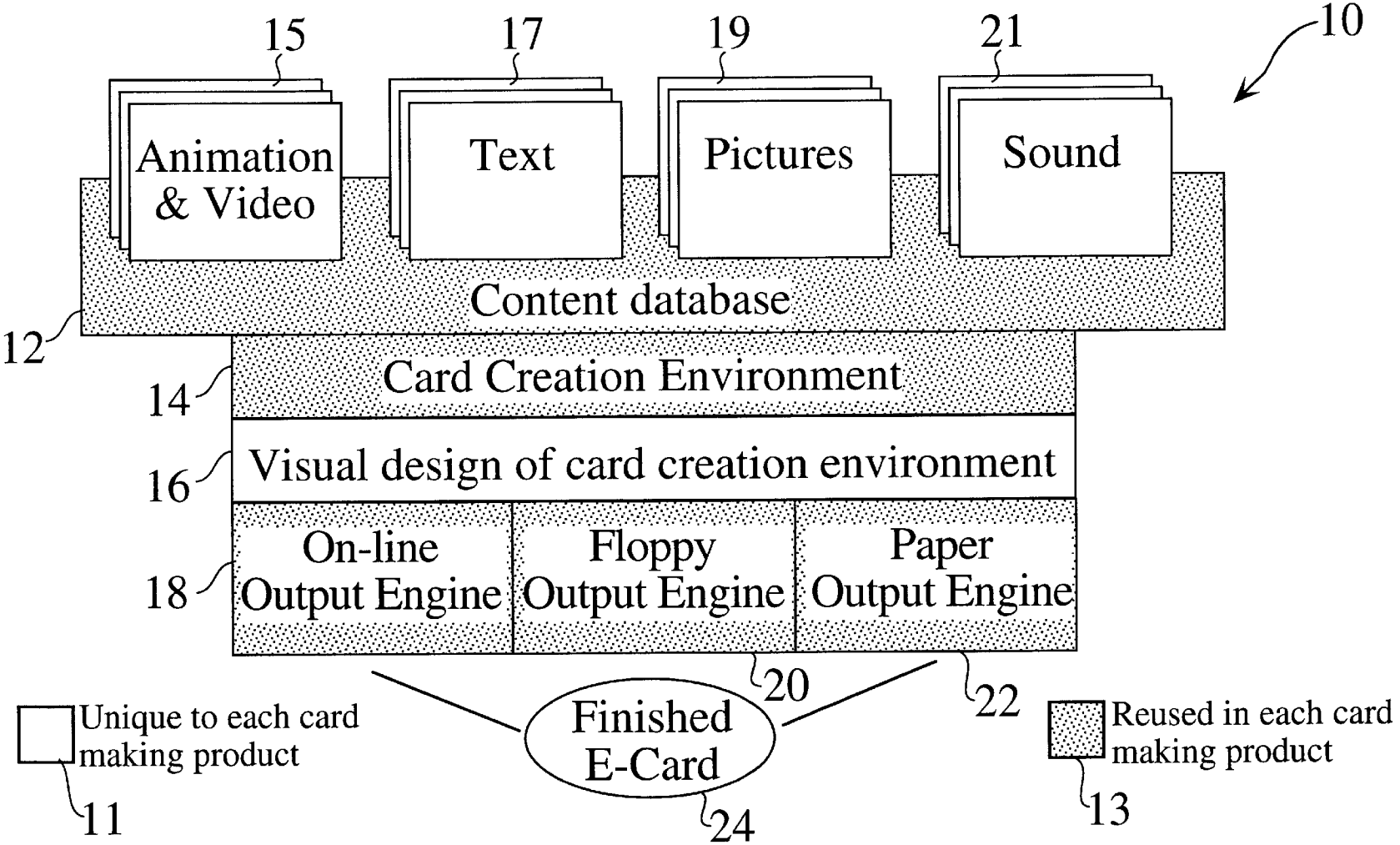
FIG. 8 is a block diagram of an electronic trading card architecture according to the invention.

FIG. 8 is a block diagram of an electronic trading card architecture 10 according to the invention. A content database 12 provides multi-media source data for card generation and activities, and includes animation and video information 15, text 17, pictures 19, and sound 21. A card creation environment 14 provides user access to the content database 12 through a graphic user interface that implements the visual design of the card creation environment 16. Electronic trading cards generated in the card creation environment 14 may be transferred on-line via and on-line output engine 18, in electronic format stored on a floppy disk via a floppy output engine 20, and in paper format via a paper output engine 22. The resulting finished ETC (E-card) 24 may then be used a part of an electronic trading card activity (discussed in greater detail below).

One important feature of the invention is the provision of an integrated electronic trading card architecture that may produce electronic trading cards that incorporate any desired content in a consistent format, such that the act of trading is seamless and trivial exercise without regard to content. Therefore, the invention provides the various reusable modules discussed above, as shown on FIG. 1 by the key 13, to which any desired unique content may be added (e.g. sports material, entertainment material), as shown by the key 11.

Figure 9:
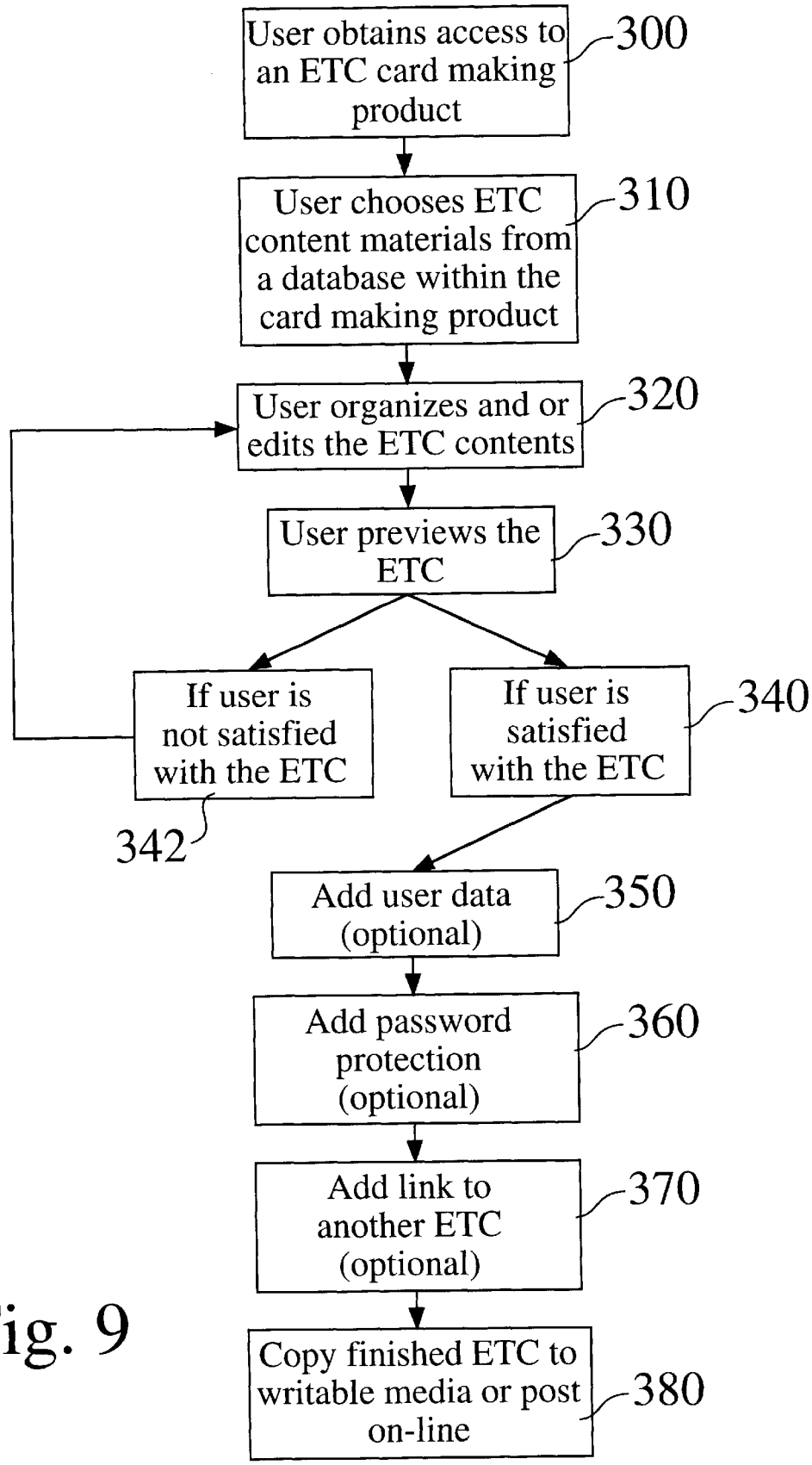
FIG. 9 is a flow diagram of an end user model for the creation of electronic trading card according to the invention.

End User Creation of ETCs. FIG. 9 is a flow diagram of an end user model for the creation of electronic trading card according to the invention. In the figure, a user obtains access to an ETC card making product (300) and chooses ETC content materials from a database within the card making product (310). Such content materials can include athletes, cartoon characters, fictional characters, reference and educational materials, historical figures, movie actors, collectible items, games, personal photographs, maps, products for sale, museum pieces, and nature.

The user then organizes and/or edits the ETC contents (320) and previews the ETC (330). If the user is satisfied with the ETC (340), he may optionally add user data (350), password protection (360), and links to another ETC (370). The user then copies the finished ETC to a writable medium or posts the ETC on-line (380).

If the user is not satisfied with the ETC (342), he continues to edit (320) and preview (330) the ETC until he is satisfied (340).

The invention includes an electronic trading card making engine, which is a software program hereafter called the ETC-making engine. This engine is a platform-independent software program authored in C++ that allows users to select from digital libraries of content materials, e.g. photographs, text, sound effects, music, animation, illustration and motion pictures, to create customized and or personalized electronic trading cards. Users may invoke built-in copy protection functions to create scarcity and use password protection in conjunction with public/private key encryption to allow recipients of the card to confirm the authenticity and source of the ETC.

By interacting with a graphical user interface, commercial creators of ETCs as well as end-users can organize, sequence, and customize content materials from the digital content libraries. The ETC-making engine then compiles the associated files into an ETC which conforms to the proprietary ETC file format. The resulting ETC is then saved and/or copied to writable storage media, and/or transmitted through computer or telecommunications networks to facilitate ETC collecting, trading, or gaming activities, which are described below.

The ETC-making engine and content database. An important concept of this design is the independent and modular nature of the ETC-making engine and associated content database. Once content materials are digitized into pre-specified digital formats, they can be loaded into the ETC-making engine database without modification to the ETC-making engine itself. This supports fast and efficient creation of ETC-making products using a wide variety of content materials such as athletes, cartoon characters, fictional characters, reference and educational materials, historical figures, movie actors, collectible items, games, personal photographs, maps, products for sale, museum pieces, and nature.

ETC-based Activities. The ETC architecture supports number of card-based activities, primary among them being games:

ETC games. ETC games are distinct from existing computer or video games in that the game architecture includes disassociated components in the form of ETCs. Examples of this functionality:

ETC Adventure Games. ETC adventure games are similar in structure to existing video and computer games except for a unique distinction: they require ETCs to move the action of the game forward and in some cases also generate ETCs in the course of a game.

Disassociated ETCs can serve a number of functions in an adventure game:

- to offer clues, hints or other special properties that give the owner of the ETC an advantage when playing the game;
- to augment an existing game with additional levels of play, characters or other game elements; and
- as a reward or as proof that a player has solved a level of play in the game.

As an example, a user might purchase an ETC adventure game on CD-ROM.

This game is structured with increasing levels of difficulty. As clues are collected and each level of the game is solved, a previously hidden ETC is revealed which gives a clue to the next level of play. When all levels of the game are solved, the user has a complete set of ETCs from that game that prove each level was solved and are time stamped and personalized with the user's name or other personal data.

Figure 10:
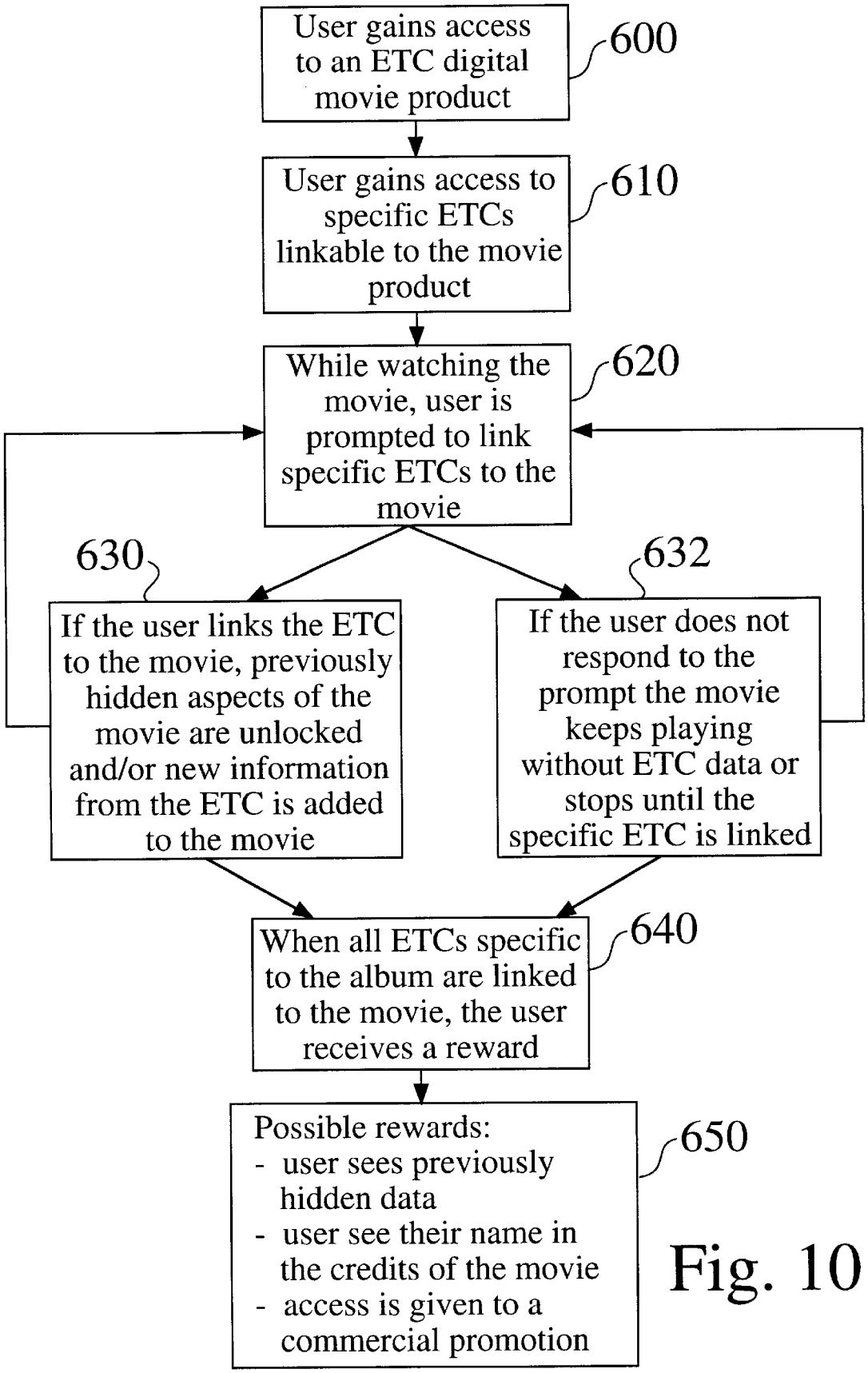
FIG. 10 is a flow diagram of an electronic trading card movie linking model according to the invention.

ETC Interactive Movie Games. FIG. 10 is a flow diagram of an electronic trading card movie linking model according to the invention. In the figure, a series of disassociated ETCs are linked to a digital movie, i.e. any form of motion picture, such as a narrative, animation, and documentary motion picture. The user gains access to an ETC digital movie product (600) and access to specific ETCs that are linkable to the movie product (610). While watching the movie, the user is prompted to link specific ETCs to the movie (620). If the user links the ETC to the movie, previously hidden aspects of the movie are unlocked and/or new information from the ETC is added to the movie (630). If the user does not respond to the prompt the movie may continue playing without the ETC data, or the movie may stop until the specific ETC is linked (632). When all of the ETCs that are specific to the album are linked to the movie, the user receives a reward (640) that may include such items as the ability to see previously hidden data, seeing their name in the credits of the movie, and gaining access to promotional materials (650).

An ETC interactive movie released in digital format requires disassociated ETC plot and character cards to advance or effect the plot of the movie. ETC interactive movies may be created by restructuring existing popular movies or may be new movies especially produced with ETC enhancement in mind. Because the movie is released as digital data, it is possible to create ETC video and sound that is compatible with the movie data format and can be inserted into it.

Example. A movie is released in digital format. As released, the movie plays in a linear fashion from beginning to end. However, if the user adds specific ETC plot or character cards to the movie at specified points in the story, the story is enhanced by:

- the addition of new scenes;
- changes in the direction and outcome of the narrative;
- the appearance of new elements in existing scenes; and
- the appearance of new characters in existing scenes.

Example. An electronic "Diamond Card" could effect the plot by placing a gigantic diamond in a certain scene. The diamond then distracts a greedy character who steals it. If the diamond is not placed in the scene there is no distraction and no theft. An electronic "Key Card" could allow an otherwise trapped prisoner to escape. In a two-player scenario, each player could use their "Warrior" cards to add soldiers to each of two opposing armies that are about to fight in a battle scene. The addition of soldiers via ETCs determines the outcome of the fictional on-screen battle.

Character cards can renew a movie. Once an audience grows familiar with a movie, a disassociated ETC movie card released after the movie could be added and cause surprising changes in the story.

ETC Series Games. Example. These cards distributed as a series of increasingly difficult puzzle challenges, with each ETC in the series containing a unique software puzzle. As you solve each puzzle, a score number displayed on the card increments and hidden clue graphics are revealed. Since attaining high scores are difficult, the higher the score, the scarcer the card. However, if the user makes a mistake when solving the puzzle the score decrements, or in the case of serious errors the card self-destructs and erases itself. The game is won when a user has a complete, unbroken series of cards with all puzzles completely solved and maximum scores displayed. When the user wins the game they earn the privilege of personalizing the ETC game cards with their name or other personal data.

Figure 11:
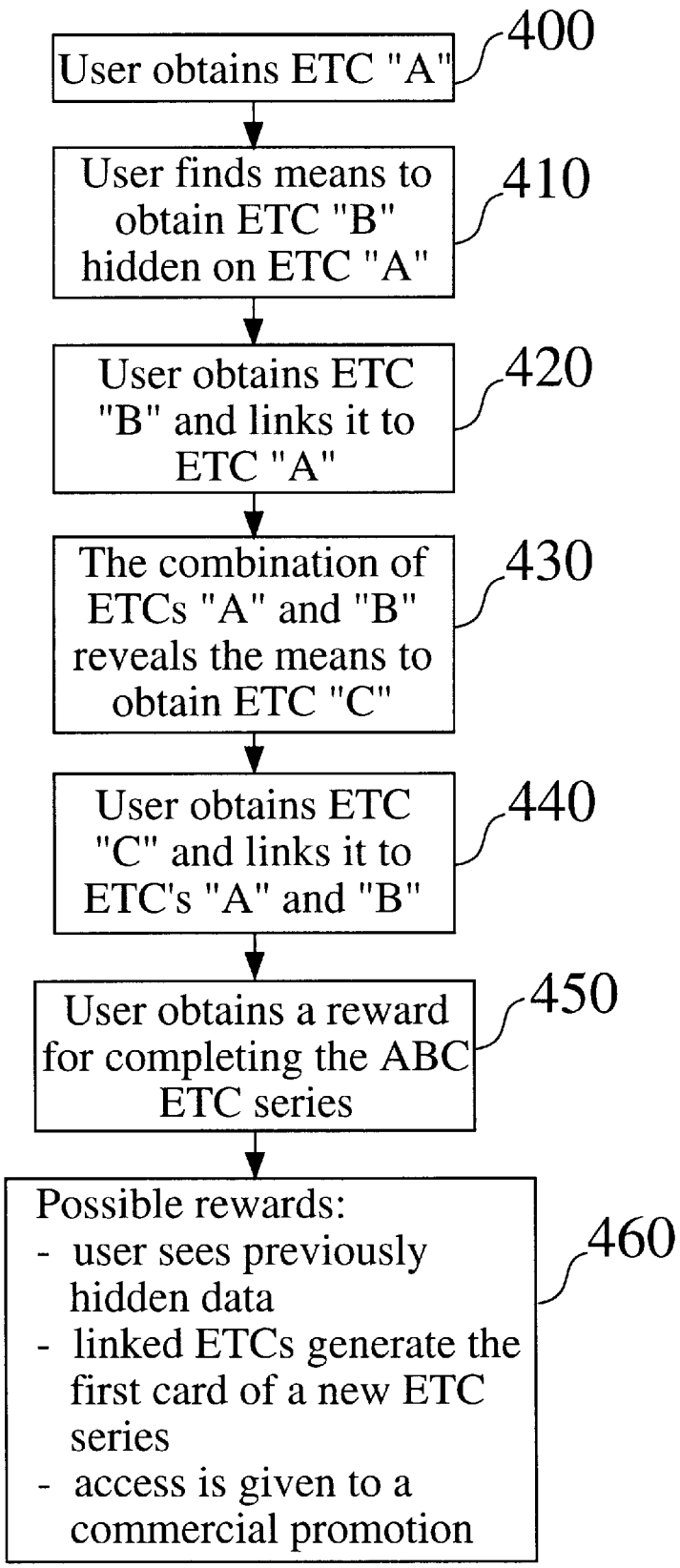
FIG. 11 is a flow diagram of an electronic trading card linking model according to the invention.

ETC Linking Games. FIG. 11 is a flow diagram of an electronic trading card linking model according to the invention. In the figure, a series of three disassociated ETCs, "A", "B", and "C" are liked. The user first obtains the ETC "A" (400), and then finds means to obtain the ETC "B", directions for which are hidden on ETC "A" (410). The user obtain ETC "B" and links it to ETC "A" (420). the combination of ETCs "A" and "B" reveals the means to obtain ETC "C" (430). The user then obtains ETC "C" and links it to ETCs "A" and "B" (440), for which the user obtains a reward for completing the "ABC" ETC series (450). The reward may include such items are the ability to view previously hidden material, the ability to generate a first card for a new linked ETC series, and access to promotional materials (460).

Example. A complete game, or game in progress, is distributed as disassociated code segments in the form of a series of ETCs. As the user collects ETCs in the series, they link together automatically and the resulting game grows, becoming deeper, more robust, and more complex. The scale of ETC linked games can range from games built from a series of as little as two ETCs or as many as hundreds that are developed, distributed, collected, and assembled into a game which grows and constantly evolves over a period of years. When the user wins the game they earn the privilege of personalizing the ETC game cards with their name or other personal data.

Figure 12:
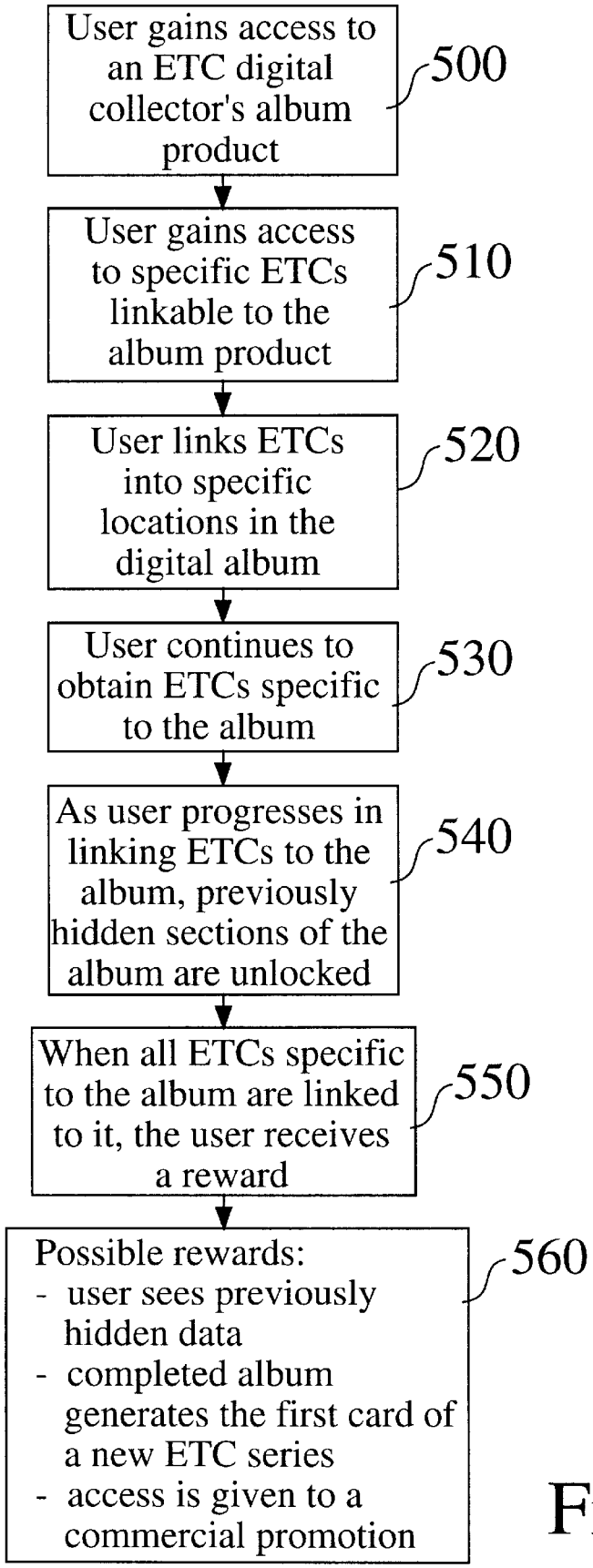
FIG. 12 is a flow diagram of an electronic trading card collector's album model according to the invention.

ETC Collecting. FIG. 12 is a flow diagram of an electronic trading card collector's album model according to the invention. In the figure, a series of disassociated ETCs are linked to an ETC digital collector's album. The user gains access to an ETC digital collector's album product (500) and gains access to specific ETCs that are linkable to the album product (510). The user links the ETCs into specific locations in the digital album (520) and continues to obtain ETCs that are specific to the album (530). As the user progresses in linking ETCs to the album, previously hidden sections of the album are unlocked (540). When all of the ETCs that are specific to the album are linked to it, the user receives a reward (550), which may include the ability to see previously hidden information, the ability to generate the first card of a new ETC series, and access to promotional materials (560).

ETC collecting is strongly supported by a number of features of the ETC invention discussed elsewhere in this document, including ETC scarcity, authenticity, compatibility with consumer on-line services, and the ETC Header Identification. ETC collecting is also supported by another unique feature of the invention, Electronic Trading Card Collection Albums. These albums are software programs designed to allow end users to integrate specific disassociated ETCs into an electronic album as they build a collection of ETCs. Although all ETC albums share this basic functionality, a number of unique attributes related to the content of the ETCs can be built into the albums:

ETC Sports Albums can also be sports games where teams are collected with each team member on their own disassociated ETC. When enough team members are collected, sports games can be played which use data on the disassociated ETCs and simulate an actual contest between the ETC team members collected. This concept is also directly applicable to a "War Game" ETC album;

ETC Key Albums are albums that reveal new features as segments of a collection are successfully completed. One example is an on-screen representation of a mysterious place, such as a haunted castle. As specific disassociated ETCs are collected, they can act as keys and reveal additional rooms in the castle. Each room has it's own series of ETCs that must be collected and stored in the room before the next room in a sequence of rooms can be opened. Besides revealing hidden areas of the castle, other events can be triggered by collected ETCs such as an animation that tells a story or the revelation of a phone number that the user may call to qualify for a discount on other ETC products;

Other examples of albums that require ETCs that are keys to reveal new features are ETC albums based on journeys or geographical explorations, where incremental stages of the journey or subjects of the exploration are revealed as specific ETCs are collected, and ETC albums based on accumulating knowledge, where each ETC represents an incremental piece of knowledge needed to perform a larger task, such as launching a rocket. As ETCs are collected the user accumulates knowledge and progresses toward the goal of launching the rocket. When the collection is complete, the rocket is launched; and Utilitarian ETC albums. These albums are software programs that are more prosaic in appearance and are used for the simple management and collection of any number from a few up to thousands of disassociated ETCs that an end user has collected.

EXAMPLES

Card Collecting Scenario.

1. Tim puts an ETC "collector's Album" CD into his multimedia player. Each album comes with a unique assortment of "starter cards" for the collection. This album is in the form of a haunted house, where each room requires a specific set of cards to complete the collection.

2. Tim needs one more card to complete the twelve card Dungeon Set.

3. He finds the missing card at a local trading card store.

4. Completing the Dungeon Set makes Tim eligible for a special award. The prisoner shows Tim the details.

5. Next week Tim's friend Jerry gives him a rare Movie Card at school. Tim's friends have been searching for this card for weeks and Jerry is the first to find it. (It was hidden in an ETC game called Castle Quest.)

6. Some electronic albums have movies on them, and the missing cards unlock key scenes from the movie. The person who originally finds the missing movie card in its hiding place can personalize it. That way, their name always appears in the credits of that movie when it is played.

Card Activity Scenario.

1. Jason puts an ETC "Castle Quest" game into his CD-ROM drive. In Castle Quest, players solve puzzles having increasing levels of difficulty. When each level is solved, the player can print out a card proving they have solved the current level and giving a clue to the next level.

2. Jason has solved four levels of the game and printed the first four clue cards. the clue cards come pre-printed in color along with the game. When Jason feeds them through his printer, his name and the date and time appear on the card. He is now working on level five.

3. Jason finally solves level five and escapes from the tower! He prints out the level six clue card.

4. On the card there is a map of Dark Valley. When Jason feeds the card through his printer a special route appears printed on the valley.

5. After three weeks Jason solves all ten levels of Castle Quest.

6. He now has a set of ten completed Castle Quest cards—each personalized with his name. Only those who have solved Castle Quest have such a set of ten clue cards. Jason is the envy of his friends at school.

Card Trading Scenario.

1. Julie and Kristin trade their favorite ETCs on a floppy disc. They are each trying to make a full set of their favorite cards.

2. They can also trade on-line with kids all over the world. Some cards have phone number built in and dials them on command.

(Michael: #3 below is kind of an unrelated idea. Will it weaken the application?)

No!

3. Some very special cards come with their own display system, so the "card" is a small plastic case housing software, a battery, a CPU, and LCD display.

4. ETC files can also be output onto paper cards, traded, and used in card games, much like traditional paper trading cards.

End User Card Making Scenario.

1. Emily wants to make a special personal ETC for her friend Amy. She puts a Card Maker CD with her favorite characters into her multimedia player.

2. She goes to the Magic Writing Desk where she will assemble and personalize her card. First, she chooses a format and setting for her card. She decides Amy's card will be a Game Card.

3. She adds a character from her favorite TV show. The character says "Hello from your best friend."

4. Emily picks a Tarot game from an assortment of small games that will fit on cards.

5. She types a secret message, hidden inside the animated magic heart where Amy will find it.

6. Emily puts the card on a floppy disc and prints a special label for the disc on colorful preformatted sheets that come with the Card Maker program.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

What is claimed is:

1. A system for the implementation of a trading card metaphor, comprising:

a disassociated computer program, consisting of a plurality of electronic trading cards (ETCs), each ETC corresponding to a disassociated computer code segment and having an electronic format that supports card scarcity and card authenticity.

2. The system of claim 1, said electronic format further comprising:

an ETC header identification code that uniquely identifies the ETC;

an optional lock and key mechanism to limit access and impose password protection on the ETC;

an ETC graphic identification code that may include any of an audio visual logo, a copyright notice, and company information;

multimedia data that may include any of animation, video, pictures, sounds, and text;

pointers to external data and programs embedded in scripts that trigger the display of external media or run external applications;

utility programs;

applications, including any of incomplete linkable code segments, games, puzzles, and utilities; and a user writable area for any of personalization, messages, voice recording, image storage, and score keeping.

3. The system of claim 2, said utility programs further comprising any of:

copy protection schemes, print drivers, telecommunications protocols, and self destruction routines.

4. The system of claim 1, wherein said ETC is transportable across a wide range of digital media, including CD-ROM, networked servers, fixed discs, floppy discs, data cards, writable optical storage, and RAM.

5. The system of claim 1, wherein said trading card metaphor is a puzzle distributed to at least two ETCs.

6. The system of claim 5, wherein said puzzle uses timing to generate scarcity in ETCs in any of the following ways:

said ETCs self-destruct or self erase after a given time has elapsed;

said ETCs are made available for limited times on on-line systems; and said ETCs are time stamped.

7. The system of claim 1, wherein said ETC is copy protected to limit the number of times said ETC can be copied.

8. The system of claim 7, said ETC further comprising:

public-key/private-key encryption means for detecting illegal copying.

9. The system of claim 1, wherein said ETC is randomly distributed in partial sets.

10. The system of claim 1, further comprising:

a runtime engine that must be present in a local computing device for a user to view and interact with an ETC, said runtime engine including media handlers and display routines, a timing mechanism, display management, and input handlers.

11. The system of claim 1, wherein said trading card metaphor further comprises:

printed/printable incomplete cards in which a portion of their printed information is missing, said missing information being provided through the use of at least one ETC, such that said incomplete card can be printed when said missing information is found, wherein disassociated information from said ETC completes said incomplete card, thereby creating a hybrid ETC/paper trading card.

12. The system of claim 1, wherein said trading card metaphor further comprises:

an adventure game, including a plurality of linked ETCs, each ETC adapted to offer clues, hints and/or other special properties that give a ETC owner an advantage when playing said adventure game.

13. The system of claim 12, wherein said ETCs augment an existing game with additional levels of play, characters, or other game elements.

14. The system of claim 12, wherein said ETCs provide either of a reward and proof that a player has solved a level of play in said game.

15. A method for implementing a trading card metaphor in an electronic trading card (ETC), comprising the steps of:

assembling and personalizing at least one ETCs, each ETC corresponding to a disassociated computer code segment and having an electronic format that supports card scarcity and card authenticity;

choosing a format and setting for said ETC;

optionally adding a personalized multimedia character to said ETC;

optionally selecting a game to be incorporated into said ETC;

optionally adding a secret message, linked to said game, to said ETC; and optionally adding links to other ETCs.

16. A method for implementing a trading card metaphor in an electronic trading card (ETC), comprising the steps of:

entering a multiroom virtual environment where each room in said environment requires a specific set of ETCs to complete an ETC collection, each ETC corresponding to a disassociated computer code segment and having an electronic format that supports card scarcity and card authenticity;

finding a missing ETC;

completing said set; and reward when said set is completed.

17. The method of claim 16, wherein said sets of ETCs comprise electronic albums that have movies on them, and wherein missing ETCs unlock key scenes from said movie.

18. The method of claim 17, wherein finding a missing movie ETC in its hiding place allows the a person finding the missing ETC personalize any of the ETC and the movie.

19. A method for implementing a trading card metaphor in an electronic trading card (ETC), comprising the steps of:

solving a puzzle having increasing levels of difficulty using a series of linked electronic trading cards (ETCs), each ETC corresponding to a disassociated computer code segment and having an electronic format that supports card scarcity and card authenticity; and reproducing a personalized certificate of completion when, and only when, each level of said puzzle is solved, said certificate of completion optionally including clues to solve a next level of said puzzle.

20. The method of claim 19, wherein said ETCs are linked such that solution of a predetermined number of ETC puzzles assembles all disassociated information necessary to reveal clues that enable completion of one level of said game; and wherein completion of a predetermined number of levels assembles all disassociated information necessary to reveal clues that enable completion of said game.

21. A method for the implementing a trading card metaphor, comprising the steps of:

a dissociating a computer program, consisting of a plurality of electronic trading cards (ETCs), each ETC corresponding to a disassociated computer code segment and having an electronic format that supports card scarcity and card authenticity.

22. The method of claim 21, further comprising the steps of:

providing an ETC header identification code that uniquely identifies the ETC;

providing an optional lock and key mechanism to limit access and impose password protection on the ETC;

providing an ETC graphic identification code that may include any of an audio visual logo, a copyright notice, and company information;

providing multimedia data on said ETC that may include any of animation, video, pictures, sounds, and text;

providing pointers on said ETC to external data and programs embedded in scripts that trigger the display of external media or run external applications;

providing utility programs on said ETC;

providing applications on said ETC, including any of incomplete linkable code segments, games, puzzles, and utilities; and providing a user writable area on said ETC for any of personalization, messages, voice recording, image storage, and score keeping.

23. The method of claim 22, wherein said utility programs comprise any of copy protection schemes, print drivers, telecommunications protocols, and self destruction routines.

24. The method of claim 21, wherein said ETC is transportable across a wide range of digital media, including CD-ROM, networked servers, fixed discs, floppy discs, data cards, writable optical storage, and RAM.

25. The method of claim 21, wherein said trading card metaphor is a puzzle distributed to at least two ETCs.

26. The system of claim 25, wherein said puzzle uses timing to generate scarcity in ETCs in accordance with any of the following steps:

self-destructing or self erasing said ETC after a given time has elapsed;

limiting ETC availability times on on-line systems; and time stamping said ETC.

27. The method of claim 21, further comprising the step of:

copy protecting said ETC to limit the number of times said ETC can be copied.

28. The method of claim 27, said ETC further comprising:

detecting illegal copying with public-key/private-key encryption means.

29. The method of claim 21, wherein said ETC is randomly distributed in partial sets.

30. The method of claim 21, further comprising the step of:

requiring the presence of a runtime engine in a local computing device before a user can view and interact with an ETC.

31. The method of claim 21, wherein said trading card metaphor further comprises the step of:

providing a printed/printable card, where a portion of said card's printed information is missing;

using at least one ETC to find said missing information, such that said incomplete card can be printed when said missing information is found, wherein disassociated information from said ETC completes said incomplete card, thereby creating a hybrid ETC/paper trading card.

32. The method of claim 21, wherein said trading card metaphor further comprises an adventure game, including a plurality of linked ETCs, each ETC adapted to offer clues, hints or other special properties that give a ETC owner an advantage when playing said adventure game.

33. The method of claim 22, wherein said ETCs augment an existing game with additional levels of play, characters, or other game elements.

34. The method of claim 22, wherein said ETCs provide either of a reward and proof that a player has solved a level of play in said game.

35. The method of claim 21, further comprising the step of:

trading ETCs on writable media.

36. The method of claim 21, further comprising the step of:

trading ETCs on-line.

37. The method of claim 36, wherein said ETC has a built-in phone number that is dialed on command.

38. A system for the implementation of a trading card metaphor, comprising:

a disassociated computer program, consisting of a plurality of electronic trading cards (ETCs), each ETC corresponding to a disassociated computer code segment and having an electronic format that supports card scarcity and card authenticity; said ETC including a display system, a housing, software, a battery, a CPU, and an LCD display.

39. The system of claim 38, further comprising:

means for outputting files contained on said ETC onto any of paper cards, which paper cards may be traded and used in card games.

* * * * *

UNITED STATES PATENT AND TRADEMARK OFFICE

CERTIFICATE OF CORRECTION

PATENT NO. : 6,200,216 B1
DATED : March 13, 2001
INVENTOR(S) : Peppel

It is certified that error appears in the above-identified patent and that said Letters Patent is hereby corrected as shown below:

Column 15,
Line 1, insert the words -- embodied in a tangible medium -- after "computer code segment"

Column 16,
Line 27, omit the word "multiroom"
Line 27, omit the word "each"
Line 28, omit the word "room"
Line 35, insert the words -- receiving a -- after the word "and"

Signed and Sealed this

Twenty-third Day of November, 2004

JON W. DUDAS
*Director of the United States Patent and Trademark Office*

US006200216C1

(12) EX PARTE REEXAMINATION CERTIFICATE (9967th)

United States Patent

Peppel

(10) Number: US 6,200,216 C1

(45) Certificate Issued: Dec. 3, 2013

(54) ELECTRONIC TRADING CARD

(75) Inventor: Tyler Peppel, Sausalito, CA (US)

(73) Assignee: Wildcat Intellectual Property Holdings LLC, Plano, TX (US)

Reexamination Request:
No. 90/012,365, Jun. 21, 2012

Reexamination Certificate for:

| | |
|---|---|
| Patent No.: | **6,200,216** |
| Issued: | **Mar. 13, 2001** |
| Appl. No.: | **08/398,862** |
| Filed: | **Mar. 6, 1995** |

Certificate of Correction issued Nov. 23, 2004

(51) Int. Cl.
*A63F 9/24* (2006.01)

(52) U.S. Cl.
USPC ..... 463/1; 463/43; 705/52

(58) Field of Classification Search
None
See application file for complete search history.

(56) References Cited

To view the complete listing of prior art documents cited during the proceeding for Reexamination Control Number 90/012,365, please refer to the USPTO's public Patent Application Information Retrieval (PAIR) system under the Display References tab.

*Primary Examiner* — Cameron Saadat

(57) ABSTRACT

A system for the application of a trading card metaphor to a disassociated computer program and the unique design of several hardware and software systems supports and enhances collecting, trading, game playing, and creating of digital electronic trading cards by taking the traditional trading card metaphor and uniquely updating and enhancing it for application in consumer digital media. An electronic hardware and software architecture for electronic trading cards (ETCs) has a number of components that function together as a system that support making electronic trading cards, trading electronic trading cards, activities (such as game playing) with electronic trading cards, and collecting electronic trading cards. The ETC format is embodied in the components of the electronic trading card system, which are designed to generate and accept a common proprietary electronic trading card format, so that, for example, a card created in a card-making application can be recognized by an electronic trading card album. The card format supports both scarcity and authenticity, which are essential to card collecting and trading, within a disassociated computer code segment.

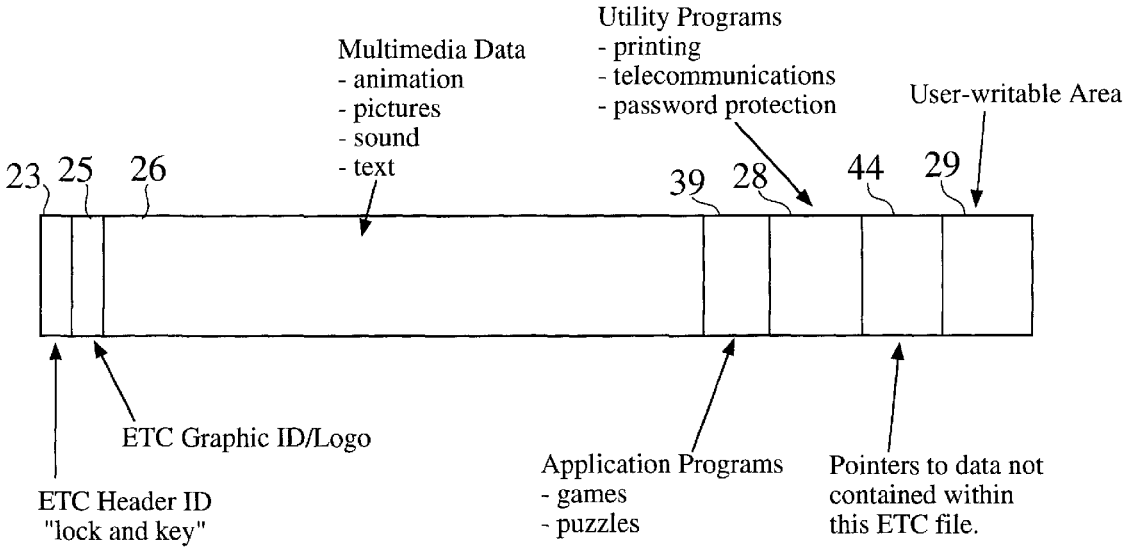

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 21 are cancelled.

Claims 9, 10, 12, 13, 29, 30, 32 and 36 are determined to be patentable as amended.

New claim 40 is added and determined to be patentable.

Claims 2-8, 11, 14-20, 22-28, 31, 33-35 and 37-39 were not reexamined.

9. [The system of claim 1, wherein said ETC is randomly distributed in partial sets] *A system for the implementation of a trading card metaphor, comprising:*

*a disassociated computer program, consisting of a plurality of electronic trading cards (ETCs), each ETC corresponding to a disassociated computer code segment embodied in a tangible medium and having an electronic format that supports card scarcity and card authenticity, wherein said electronic format further comprises:*

*an ETC header identification code that uniquely identifies the ETC; and*

*a user writable area for any of personalization, messages, voice recording, image storage, and score keeping.*

10. The system of claim [1] *9*, further comprising:

a runtime engine that must be present in a local computing device for a user to view and interact with an ETC, said runtime engine including media handlers and display routines, a timing mechanism, display management, and input handlers.

12. The system of claim [1] *9*, wherein said trading card metaphor further comprises:

an adventure game, including a plurality of linked ETCs, each ETC adapted to offer clues, hints and/or other special properties that give a ETC owner an advantage when playing said adventure game.

13. [The system of claim 12.] *A system for the implementation of a trading card metaphor, comprising:*

*a disassociated computer program, consisting of a plurality of electronic trading cards (ETCs), each ETC corresponding to a disassociated computer code segment embodied in a tangible medium and having an electronic format that supports card scarcity and card authenticity;*

*an adventure game, including a plurality of linked ETCs, each ETC adapted to offer clues, hints and/or other special properties that give a ETC owner an advantage when playing said adventure game;* wherein said ETCs augment an existing game with additional levels of play, characters, or other game elements*; and*

*wherein said electronic format further comprises:*

*an ETC header identification code that uniquely identifies the ETC;*

*a lock and key mechanism to limit access and impose password protection on the ETC;*

*an ETC graphic identification code that includes any of an audio visual logo, a copyright notice, and company information;*

*multimedia data that may include any of animation, video, pictures, sounds, and text;*

*pointers to external data and programs embedded in scripts that trigger the display of external media or run external applications;*

*utility programs;*

*applications, including any of incomplete linkable code segments, games, puzzles, and utilities; and*

*a user writable area for any of personalization, messages, voice recording, image storage, and score keeping; and*

*wherein said ETC has a built-in phone number that is dialed on command.*

29. [The method of claim 21, wherein said ETC is randomly distributed in partial sets] *A method for the implementing a trading card metaphor, comprising the steps of:*

*disassociating a computer program consisting of a plurality of electronic trading cards (ETCs), each ETC corresponding to a disassociated computer code segment and having an electronic format that supports card scarcity and card authenticity, wherein said electronic format further comprises:*

*an ETC header identification code that uniquely identifies the ETC; and*

*a user writable area for any of personalization, messages, voice recording, image storage, and score keeping.*

30. The method of claim [21] *29*, further comprising the step of:

requiring the presence of a runtime engine in a local computing device before a user can view and interact with an ETC.

32. The method of claim [21] *29*, wherein said trading card metaphor further comprises an adventure game, including a plurality of linked ETCs, each ETC adapted to offer clues, hints or other special properties that give a ETC owner an advantage when playing said adventure game.

36. The method of claim [21] *29*, further comprising the step of:

trading ETCs on-line.

*40. The method of claim 29, wherein said electronic format further comprises: a lock and key mechanism to limit access and impose password protection on the ETC; an ETC graphic identification code that includes an audio visual logo, a copyright notice, and company information; multimedia data that includes animation, video, pictures, sounds, and text; pointers to external data and programs embedded in scripts that trigger the display of external media or run external applications; utility programs, including printing, telecommunication protocols, and self destruction routines; applications, including incomplete linkable code segments, games, puzzles, and utilities; and a user writable area configured for personalization, ASCII messages, voice recording, image storage, and score keeping; and wherein said ETC has a built-in phone number that is dialed on command.*

* * * * *